US009476256B2

(12) United States Patent
Pursimo et al.

(10) Patent No.: US 9,476,256 B2
(45) Date of Patent: Oct. 25, 2016

(54) MINING VEHICLE AND METHOD OF MOVING BOOM

(71) Applicant: SANDVIK MINING AND CONSTRUCTION OY, Tampere (FI)

(72) Inventors: Juha Pursimo, Tampere (FI); Sami Hanski, Tampere (FI); Juha Lassila, Tampere (FI); Tuomo Pirinen, Tampere (FI)

(73) Assignee: SANDVIK MINING AND CONSTRUCTION OY, Tampere (FI)

( * ) Notice: Subject to any disclaimer, the term of this patent is extended or adjusted under 35 U.S.C. 154(b) by 466 days.

(21) Appl. No.: 14/060,857

(22) Filed: Oct. 23, 2013

(65) Prior Publication Data

US 2014/0110168 A1 Apr. 24, 2014

(30) Foreign Application Priority Data

Oct. 24, 2012 (EP) ..... 12189758

(51) Int. Cl.
*E21B 7/02* (2006.01)

(52) U.S. Cl.
CPC ..... *E21B 7/025* (2013.01); *E21B 7/022* (2013.01)

(58) Field of Classification Search
CPC ..... E21B 7/022; E21B 19/08; E21B 7/025
USPC ..... 173/1, 2, 4, 8, 9, 10, 11; 175/24, 50
See application file for complete search history.

(56) References Cited

U.S. PATENT DOCUMENTS 4,240,511 A * 12/1980 Mashimo ..... E21B 7/022 173/1
4,343,367 A 8/1982 Mashimo
4,501,199 A 2/1985 Mashimo
4,698,570 A * 10/1987 Satoh ..... G05B 19/404 173/193
4,712,624 A * 12/1987 Mashimo ..... G01C 7/06 173/193
4,881,604 A * 11/1989 Orthwein ..... G05B 19/4163 173/11
5,054,990 A * 10/1991 Schaeff ..... E02F 3/303 212/247
5,088,020 A 2/1992 Nishida et al.
5,178,328 A * 1/1993 Broyhill ..... A01M 7/0075 172/311
5,748,097 A * 5/1998 Collins ..... E02F 3/437 340/685
6,062,650 A * 5/2000 Smith ..... E21C 35/24 299/1.4
6,460,630 B2 * 10/2002 Ahtola ..... E21B 47/022 175/45
7,681,660 B2 * 3/2010 Muona ..... E21B 7/022 173/1
8,527,158 B2 9/2013 Faivre et al.
2010/0006337 A1 1/2010 Kosoric
2010/0044107 A1 * 2/2010 Keskinen ..... E21D 9/006 175/24

FOREIGN PATENT DOCUMENTS

DE 3642694 A1 7/1988
JP 07229385 A 8/1995
JP 7229385 A 8/1995
JP 2000017695 A 1/2000
JP 2010216183 A 9/2010
JP 2010525192 A 12/2010
WO 92/06279 A1 4/1992
WO 9206279 A1 4/1992
WO 03048524 A1 6/2006
WO 2011104440 A1 9/2011

* cited by examiner

*Primary Examiner* — Nathaniel Chukwurah
(74) *Attorney, Agent, or Firm* — Corinne R. Gorski

(57) ABSTRACT

The disclosure relates to a mining vehicle and a method of moving a boom of a mining vehicle. The boom is provided with several boom joints and there is a mining work device at a distal end of the boom. One or more boom joint positions are determined and stored in a memory medium. A control unit of the mining vehicle may automatically move the boom to a predetermined transport position.

15 Claims, 3 Drawing Sheets

MINING VEHICLE AND METHOD OF MOVING BOOM

RELATED APPLICATION DATA

This application claims priority under 35 U.S.C. §119 to EP Patent Application No. 12189758.1, filed on Oct. 24, 2012, which the entirety thereof is incorporated herein by reference.

SUMMARY

The disclosure relates to a mining vehicle, and particularly to a system for moving a boom of the mining vehicle.

The disclosure further relates to a method of moving a boom of a mining vehicle and to a computer program for executing control for moving the boom.

In mines and other work sites, various mining vehicles, i.e. mobile mining machines, are used. The mining vehicle is provided with a boom and a mining work machine on the boom. The boom is moved during use between different working positions. Controlling the boom is typically a demanding and time consuming task, because the boom structure is complex. The boom usually comprises multiple boom actuators and joints the setting of which to a desired position using manual controls is not always intuitive. Furthermore, visibility of the operator to a working site may be poor and available free space is limited.

An object of the invention is to provide a novel and improved mining vehicle and a method for moving a boom of the mining vehicle.

According to an aspect of the invention, there is provided a mining vehicle wherein at least one position of the boom, such as position(s) of boom joint(s), is predetermined; and a control unit of the mining device is configured to move the at least one boom to the pre-determined position in response to a received control command. A transport position relative to the mining vehicle may be pre-defined for the boom, and the control unit is arranged to employ stored data on the transport position of the boom and automatically move the boom from any current position to the defined transport position.

According to an aspect of the invention, there is provided a method, utilizing a transport position relative to the mining vehicle pre-defined for the boom, and employing stored data on the transport position of the boom and automatically moving the boom from any current position to the defined transport position. An advantage of the disclosed solution is that work of the operator becomes easier and less demanding. The boom can be moved to the transport position accurately and also boom collisions can be avoided.

According to an embodiment, one or more predetermined positions of the boom joints are defined and executed relative to the rock drilling rig. Thereby the predetermined positions are not according to a drilling plan, for example.

According to another embodiment, one or more target positions of the boom are taught for the boom control system. The boom can be moved under manual control in a desired position and the position can be stored in a memory medium. It is possible to store the current position of one single boom joint, positions of several selected boom joints or all joints of the boom. The teaching process is rather simple to implement. Another benefit is that the teaching process is visual whereby the operator has a general view of the situation. For executing this embodiment a mining vehicle comprises means for teaching one or more boom joint positions and means for storing the taught positions.

Further, a control unit of the mining vehicle may be arranged to assist the teaching and storing processes.

According to still another embodiment, one or more target positions of the boom are input for the boom control system. It is possible to feed position data by means of an input device, such as a keypad or touch screen. Alternatively, the position data can be retrieved from a memory device, or it can be transmitted to the control unit from an external control unit or server.

According to yet another embodiment, at least one position of the mining work device is predetermined and positions of boom joints realizing the position are stored in a memory medium. The control unit may read the stored data on the boom joints and on the basis of that data automatically move the mining work device to the predetermined position.

According to another embodiment, the mining vehicle is a rock drilling rig comprising at least one drilling boom and a drilling unit at the distal end of the drilling boom. The drilling unit comprises an elongated feed beam and a drilling machine supported on the feed beam longitudinally movably. One or more pre-determined positions are defined for the drilling boom joints.

According to still another embodiment, the control unit is provided with one or more boom moving sequences for controlling the boom so as to move the mining work device and boom parts via one or more predetermined intermediate positions to a target position. The boom can be positioned at successive pre-determined positions. This way, the boom may be moved through a collision-free path towards the target position. The movement path is not always the shortest one, but collision against a control cabin, a carrier, other booms or parts of the mining vehicle, and the ground can be avoided. Moreover, hydraulic hoses, electric cables and sensors may require that the boom has to be moved according to predetermined steps in order to avoid them to be damaged.

According to an embodiment, an inverse teaching process is employed when defining a moving sequence for the boom control system. In case a boom moving sequence is needed for moving the boom in a certain way and via specific positions to a target position, an inverse teaching can be employed. At first the boom is moved to the desired target position, the position is stored in the memory, and thereafter the boom is moved under manual control to one or more intermediate positions, which are stored. The created moving sequence is stored. When the sequence is run, the boom is moved from its current position via the defined intermediate positions to the defined target position.

According to an embodiment, the carrier is provided with one or more transport supports for the boom. The transport support is a physical support element against which the boom or the mining work device can be placed, when the carrier is moved. When the boom rests on the transport support, center of mass of the boom system is lower as compared to the normal operational position. This way, stability of the mining vehicle is improved for the transport drive.

According to an embodiment, the transport position may be without any physical transport support. The transport position may be designed so that, the center of mass of the boom system is at a low level and that the boom system needs less space than in the normal operation. This way, stability and handling characteristics of the mining vehicle are improved for the transport drive. An additional advantage is that, since the boom can be moved automatically and rather fast to the transport position under the control of the control unit, temptations of the operator to drive the mining vehicle without moving the boom to the transport position can be avoided. The control unit may prevent the driving of the carrier, or the driving speed may be limited in response to detecting that the boom is not driven to the transport position. Further, the control unit may give an alarm if the carrier is driven for the duration of a set time or distance limit without placing the boom into the transport position.

According to another embodiment, the transport position is taught for the boom control system. In the teaching process the boom may be first moved manually to the desired transport position where the boom is against a transport support, for example. The position of the boom and the boom joints are then stored. If desired, an inverse teaching process may be employed when defining a transport moving sequence for the boom control system.

According to an embodiment, a taught position is deleted automatically from a memory medium in response to a predetermined action, such as shutting down the device, or completing a certain operating stage or cycle. This feature ensures that old taught positions do not cause problems for the control. Thereby updating of the desired positions is secured.

According to still another embodiment, a calibration procedure for the measuring means of the boom is carried out when the boom is in the transport position and supported against at least one transport support. When the boom rests against the transport support the position of the boom is accurate and stabile, whereby calibration is easy to execute.

According to yet another embodiment, the predetermined positions of the boom joints are stored as measuring values in a memory medium. The predetermined positions can be taught for the boom control system by moving the boom manually and gathering the measuring values from sensors, measuring devices and corresponding measuring means. When moving the boom to the predetermined position, the boom control system uses the stored measuring values. An advantage of the use of the stored measuring values is that possible calibration inaccuracies of the measuring means do not affect the actual positioning accuracy of the boom. That is because the values are gathered and reproduced by the same measuring means. It is a question of relative accuracy and not absolute accuracy.

According to an embodiment, one or more intermediate positions are determined for the boom between the operating position and a predetermined target position. Position data of the intermediate positions may be stored in a memory device and the control unit may read the stored data on the target position and one or more intermediate positions of the boom and automatically move the boom from the operating position to the target position via the defined intermediate positions. The intermediate positions are determined so that the boom system and the mining work device on the boom do not collide with any other parts of the mining vehicle or the ground. There may also be operational and measuring technical reasons for utilizing the intermediate positions and a moving sequence.

According to another embodiment, one or more intermediate positions are determined for the boom between the operating position and a predetermined transport position. Position data on the intermediate positions may be stored in a memory device and the control unit may read the stored data on the transport position and one or more intermediate positions of the boom and automatically move the boom from the operating position to the transport position via the defined intermediate positions.

According to an embodiment, the boom can be driven automatically to a predetermined neutral position. The neutral position may be defined by a teaching process or an input device. The boom has a range and a predetermined neutral position therein. The neutral position may be a geometrical center position, or alternatively a position substantially in the center of the working area of the boom, such that the working area can be easily and comprehensively exploited. The neutral position may also include pre-alignment of the boom and feed according to the direction of the holes to be drilled. Further, the neutral position may include pre-alignment of the boom and feed to compensate for alignment errors resulting from driving the feed into support against the ground. The control unit may automatically move the boom to the neutral position. The automatic control may be initiated by a control command of the operator. For example, when the boom is in the geometrical center position, the boom reach is well exploitable. Such starting position of the boom may be called initial position also. This feature of predetermined neutral or initial position expedites positioning of the boom at the work site.

According to an embodiment, the mining work device is provided with one or more inclinometers for measuring orientation with respect to gravity. It is rather simple to fasten the inclinometer to a side surface of a feed beam, for example. The mining work device, such as a rock drilling unit, may have a substantially vertical operational position and a substantially horizontal transport position. The control unit receives measuring data from the inclinometer and utilizes the measuring data when moving the boom. The control unit may also utilize the measuring data when moving the boom to the transport position, whereby at least lateral swing and forward-backward tilt of the mining work device are determined. The control unit may be arranged to move at least a boom joint affecting the lateral swing to a predetermined transport position and to keep the swing joint unchanged when moving the boom to the transport position. Thus, the predetermined position of the swing joint is one intermediate position through which the boom is moved towards the transport position. The swing joint is moved to its predetermined position when the mining work device is still in a vertical position and measuring with the inclinometer is possible. After the mining work device is turned to a horizontal position, measuring with the inclinometer is no longer possible. The use of the disclosed procedure eliminates the need for any additional sensors and instrumentation. Let it be mentioned that the tilt joint of the boom can be driven against a physical transport support in the transport position, whereby there is no need for accurate positioning measurements in the tilt direction, when moving the boom to the transport position. In addition to inclinometers, sensors of some other type may also have limited operational ranges, which can be taken into account in the control unit when determining moving sequences of the boom.

According to still another embodiment, the mining work device is provided with one or more sensors or measuring devices having an operating range, wherein measuring can be executed accurately. The control unit takes into account the operating ranges of the sensors and controls the boom via at least one intermediate position to a target position. In the intermediate position the control unit moves at least one boom joint to a predefined position that is needed in the target position. The preadjusted joint is kept unchanged when moving the boom from the intermediate position towards the target position. The moving sequence of the boom joints is thus affected by the operating ranges of the sensors and measuring devices.

According to an embodiment, the control unit starts a movement procedure towards a predetermined position after receiving a control command from the operator. The control unit may require that an additional acknowledgement from the operator is received before beginning the movement procedure. The manual control commands may be executed by pressing bush buttons or corresponding physical command means in a control unit, or by using a pointing device in a display unit, for example. This embodiment presents a very simple procedure for initiating the movement procedure.

According to yet another embodiment, the control unit may monitor control commands input by the operator and notes when the boom is moved towards a direction that is exceptional and does not belong to the current planned operation procedure. The control unit detects such diverging movements of the boom and considers them as a need to start moving the boom to a transport position or any other predetermined position. The control unit may automatically start the transport movement procedure or alternatively it may begin the procedure after receiving an acknowledgement from the operator. By this feature the operation can be further automated and expedited.

According to an embodiment, the control unit monitors movements of a control device and detects when the control device is moved to a predetermined extreme position. The control unit recognizes the extreme position of the control device and interprets it as a request for starting to move the boom from the operational position to a predetermined position, or vice versa. The predetermined position may be a transport position.

According to another embodiment, the predetermined position is defined for the installation of a support tube that may be inserted at least partly inside an opening of the drill hole. After collaring the drill hole the drilling may be interrupted and a drilling unit may be moved away from the drill opening to an installation position for the duration of installing the support tube. The support tube prevents loose soil dropping inside the drill hole. After the support tube has been installed the drilling unit is positioned back to the drilling position and the drilling continues through the support tube. The installation position and the collaring position can be determined as predefined positions and boom joint positions can be stored for these predetermined positions. When executing the disclosed installation procedure the boom can be moved automatically to the installation position and back to the drilling position.

According to an embodiment, at least one predetermined position is defined for inspecting collaring of a drill hole. In this embodiment drilling is interrupted after collaring cycle or the collaring cycle is interrupted for ensuring that the drill hole has a proper start. A drilling unit is moved away from the drill hole start point for the duration of the inspection. Same principle may be utilized when there is need to inspect condition of a drill bit or any other drilling equipment. The inspecting position and/or the drilling position can be determined as predefined positions and boom joint positions can be stored for these predetermined positions. When executing the disclosed inspecting procedure the boom can be moved automatically to the inspecting position and back to the drilling position.

According to an embodiment, at least one predetermined position is defined for changing a drill bit. A rock drilling rig may comprise a changing device for changing drill bits. A boom can be moved to a predetermined change position so that the drill bit can be reached by the changing device and the changing can be executed. In addition to drill bits also other drilling equipment, such as drill rods, can be changed by means of a suitable changing device. Then there is a need for a predetermined change position too. Further, the rig may be provided with a tool-grinding device for servicing the drill bits. The boom can be moved to a predetermined bit servicing position where the bit is at the tool-grinding device. The original drilling position, the change position and the bit servicing position can be determined as predefined positions and boom joint positions can be stored for these predetermined positions. When executing the disclosed procedures the boom can be moved automatically to the predetermined positions.

According to yet another embodiment, at least one predetermined boom position is defined for adding, inspecting and/or servicing the boom, a drilling unit, a bolting unit, a rod magazine or any other mine work unit, an auxiliary device or an actuator arranged on the boom. There may be several device related service positions predefined so that position on the boom and service operation of the observed device has been taken into account. The service positions can be determined as predefined positions and boom joint positions can be stored for these predetermined positions. When executing the disclosed procedures the boom can be moved automatically to the predetermined positions.

According to an embodiment, the control unit is configured to process position data as coordinates in a coordinate system of the mining vehicle.

According to an embodiment, the control unit is configured to process position data as coordinates in a coordinate system which is external to the mining vehicle.

According to an embodiment, the control unit is configured to process position data as coordinates in a global coordinate system.

According to an embodiment, the control unit is configured to process position data as boom joint values.

According to an embodiment, the control system includes a collision avoidance system for ensuring that the boom or the mining work device on the boom does not hit the ground, a control cabin, the carrier or any physical obstacle belonging to the mining vehicle. Dimensions and kinematics of the mining vehicle can be determined for the control unit and measuring data concerning the position of the boom can be fed from measuring sensors or devices to the control unit. The control unit may determine the position of the boom and the mining work device and may compare the positions to the obstacle data. The control unit may control the movements of the boom joints taking into account the collision analysis. The control unit may move the boom joints in such an order that the boom parts and the mining work device pass the known obstacles. Thus the boom may have one or more intermediate positions through which it is moved to the desired final position.

According to an embodiment, the control unit is arranged to monitor a transfer drive of the mining vehicle and to indicate to the operator if the boom is not in a transport position when the carrier is moved. Alternatively, the control unit may prevent the transfer drive until the boom is moved to the transport position. The control unit may be provided with a speed limit, whereby the carrier can be moved on the work site at a slow speed. Further, the control unit may take into account evenness of a driving surface and effect of the surface to on the stability of the vehicle. These features improve safety of the mining vehicle, since overturning of the mining vehicle can be prevented.

According to an embodiment, the disclosed boom control system and procedure is intended for a surface drilling rig which is designed for above ground drilling in opencast mines and other working sites, such as in road building, construction and other corresponding work sites.

According to an embodiment, the disclosed boom control system and procedure is intended for an underground drilling rig which is designed for drilling in underground production mines, tunnel work sites and when creating different rock cavities and storage halls.

According to an embodiment, the disclosed boom control system and procedure is intended for a bolting vehicle, which is provided with one or more bolting booms and a bolting unit in the bolting boom.

According to an embodiment, the disclosed boom control system and procedure is intended for one of the following vehicles: a measuring vehicle, a charging vehicle, a concrete spraying vehicle, a scaling vehicle.

According to another embodiment, the disclosed automatic boom control procedure is carried out by executing one or more software or computer program designed for the purpose. The computer program comprises program code means configured to execute the disclosed functions and steps when being run on a computer.

According to an embodiment, at least some of the above illustrated features are applied for moving or returning the boom from the transport position, or another predetermined position, to an operating position. Hence, the return from a predetermined position may also be automatized.

The above disclosed embodiments can be combined to form suitable solutions provided with necessary features.

Let it be mentioned that term "mining" is interpreted widely. The term mining refers not only to conventional mines but also other work sites where rock is drilled or processed in any other way. Consequently, also road building, construction and other work sites can be considered to be mining work sites. Thereby a mining vehicle may refer to a vehicle used in construction and contract sites also.

BRIEF DESCRIPTION OF THE FIGURES

The embodiments are described in more detail in the accompanying drawings, in which.

For the sake of clarity, the figures show some embodiments of the disclosed solution in a simplified manner. In the figures, like reference numerals identify like elements.

DETAILED DESCRIPTION OF THE EMBODIMENTS

Figure 1:
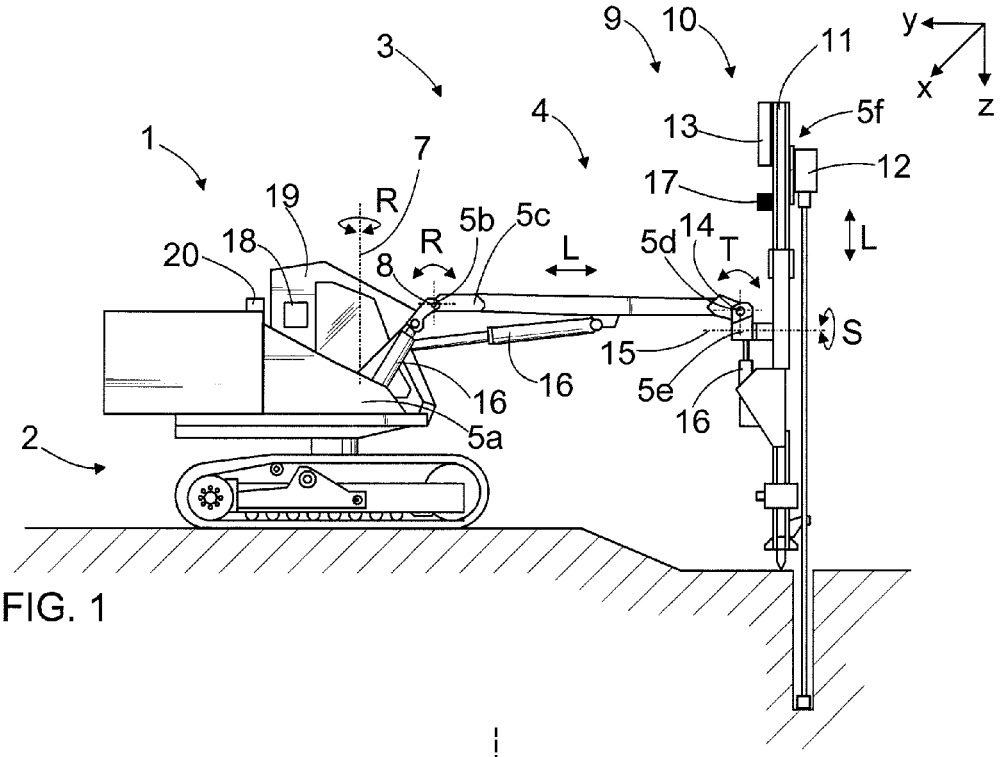
FIG. 1 is a schematic side view showing a rock drilling rig for surface working sites.

FIG. 1 shows a mining vehicle 1, in this case a rock drilling rig. The mining vehicle 1 includes a movable carrier 2 that can be transport driven to a working site 3. The mining vehicle 1 is provided with a boom 4 or boom system which includes several boom joints 5*a*-5*f* whereby it has versatile movements. The boom system 4 may have turning joints, such as 5*a*, 5*b*, 5*d* and 5*e*, and also linear joints, such as 5*c* and 5*f*. The disclosed boom system 4 has a total of six degrees of freedom. The boom 4 can be turned in lateral direction R relative to a vertical axis 7 of the boom joint 5*a*. The boom 4 can be lifted and lowered by turning in direction R relative to a horizontal axis 8 of the boom joint 5*b*, and it can be shortened and extended by moving it linearly L, for example telescopically, in relation to a boom joint 5*c*.

Alternatively, the boom joint 5*a* may be a horizontal joint for allowing moving the boom up and down. The lateral movement can be carried out by turning an upper body of the carrier relative to the lower body. At a distal end of the boom 4 there is a mining work device 9. In this case a rock drilling unit 10 includes a feed beam 11 and a rock drilling machine 12 supported by the feed beam 11. The rock drilling machine 12 can be moved linearly L on the feed beam 11 by means of a feed device 13. The rock drilling unit 10 can be turned in direction T in forward and backward directions relative to a horizontal axis 14 of the boom joint 5*d*. This boom movement is called tilting T. Further, the boom can be turned in direction S relative to a horizontal axis 15 of the boom joint 5*e*. This boom movement is called swinging S.

The boom 4 can be moved by means of boom actuators 16, some of which are shown in FIG. 1. The boom 4 can be moved by controlling the boom actuators 16 manually under control of the operator, or by utilizing automated boom control capable of moving the boom 4, or at least one boom joint 5*a*-5*f*, in one or more predetermined position relative to the carrier 2.

The boom 4 is also provided with one or more sensors 17, measuring devices or other positioning detection means for determining the position of the boom system. The measuring means may be arranged on the boom or they may locate on the carrier, for example. Measuring data of the measuring means 17 is transmitted to a control unit 18 of the mining vehicle 1. The control unit 18 may determine the position of the boom 4 and may indicate it to the operator, and may also take it into account in the automatic boom control. The boom joint positions can be calculated in the control unit too.

The mining vehicle 1 may also include a control cabin 19 on the carrier 2. The control cabin 19 may be provided with suitable control members for controlling the operation of the boom 4 and the whole mining vehicle 1. The control unit 18 may be placed inside the control cabin 19. Further, the mining vehicle may have one or more transport supports 20, against which the boom 4 can be moved before a transport drive of the carrier 2 is started. The transport support 20 may be a physical support piece, such as a rubber pad or it may be an elongated support structure pointing upwards from the carrier 2.

As can be seen in FIG. 1, the transport support is arranged next to the control cabin 19. There is little space on the carrier 2, whereby the boom has to be moved to the transport position with accurate movement control. Also, there is often a need to move the boom to the transport position in a certain manner and following a designed sequence of movements. Otherwise there is a risk that the boom 4 or the drilling unit 10 could collide with the control cabin 19, the carrier 2 or the ground.

Figure 2:
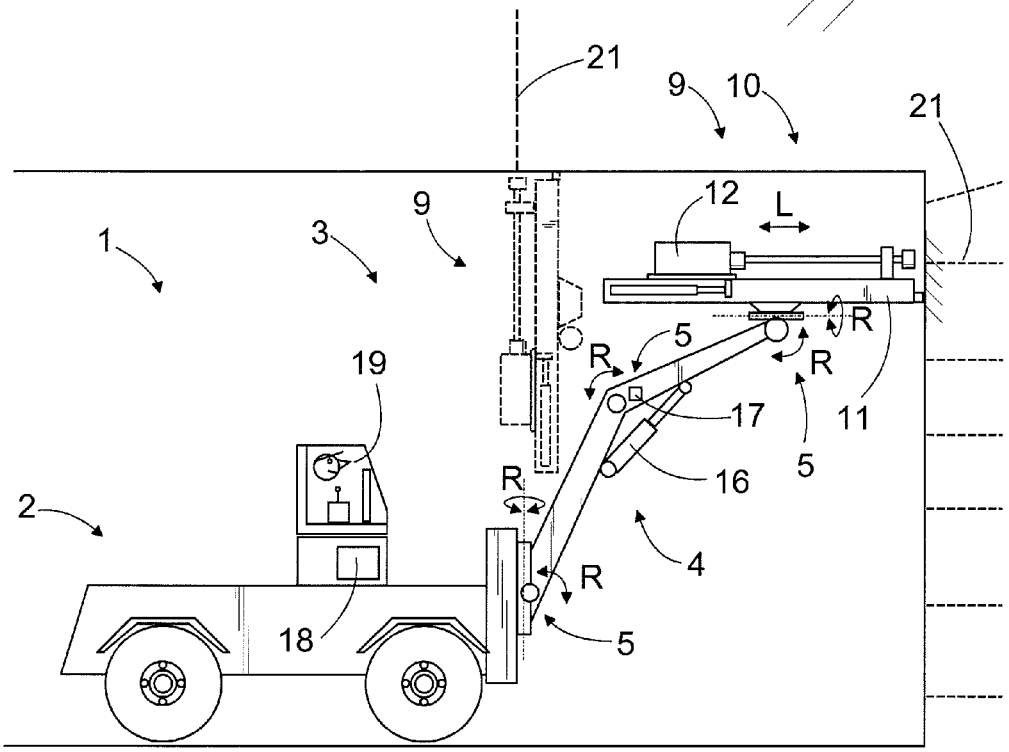
FIG. 2 is a schematic side view showing a rock drilling rig for underground working sites.

FIG. 2 shows another embodiment of rock drilling rig 1, which is suitable for drilling horizontal drill holes 21 to a face of a tunnel or similar underground rock cavity. In some cases, the drilling unit 10 can be turned transverse to the tunnel for drilling blasting or reinforcing holes to a ceiling and walls of the tunnel. The rock drilling rig may include several booms, whereby it may have at least one drilling boom with a drilling unit and one bolting boom with a bolting unit. Furthermore, the mining work device may also be a feed unit for feeding blasting or soldering material into the drill holes 21. The boom 4 is provided with several boom joints 5 and it can be positioned in versatile manner in different positions. The boom 4 can be controlled according to control principles disclosed in this patent application. The underground mining vehicle may also have predetermined transport positions for the booms.

Figure 3:
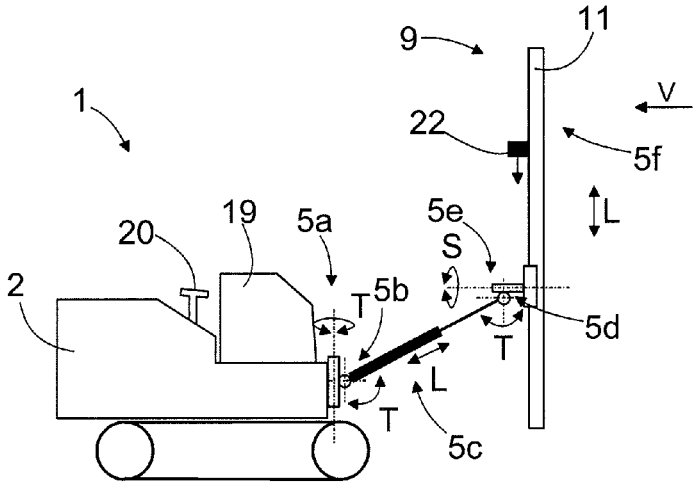
FIG. 3 is a schematic side view showing a boom system of a rock drilling rig and degrees of freedom of the boom system.
Figure 4:
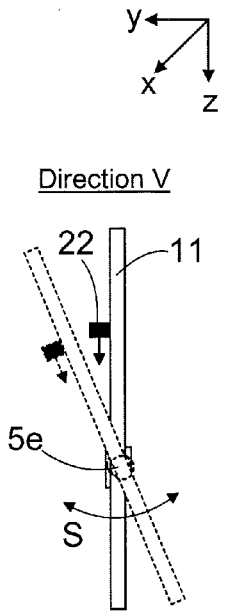
FIG. 4 shows schematically and in direction V swinging of the drilling unit in lateral direction.

FIG. 3 illustrates in a simplified manner boom movements of a mining vehicle 1. As can be noted, the boom 4 is slightly different to the one shown in FIG. 1. For the sake of clarity, FIG. 3 discloses the mining vehicle 1 in a simplified manner. The boom 4 has six degrees of freedom and comprises several boom joints 5*a*-5*f*. The mining work device 9 may be provided with one or more inclinometers 22 for determining its vertical position. The inclinometer 22 can produce reliable measuring results only when it is measuring vertical positions relative to the gravity. This is a reason, in boom transport process, for moving the mining work device to a vertical position relative to a boom joint 5*e*. In FIG. 4 it is illustrated that swing S is set vertical. After this, the boom joint 5*e* is no longer adjusted when moving the boom 4 to the transport position. The measuring result of the inclinometer it utilized when it is still possible. Thanks to this procedure, no additional sensors and instrumentation is needed. Let it be mentioned that, in addition to vertical positions, also inclined positions can be measured by means of inclinometers.

Figure 5:
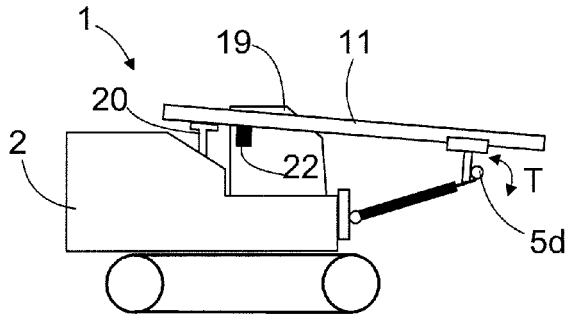
FIG. 5 shows schematically the rock drilling rig of FIG. 3 in a situation where the boom is moved to a transport position.

In FIG. 5 the boom 4 is moved to its transport position where it rests on the transport support 20. There is no need to make accurate measuring with the inclinometer 22 when controlling the tilt T movement towards the transport support 20. In connection with other boom joints there may be sensors other than inclinometers. The boom 4 can be moved automatically to the vertical position relative to the swing joint 5*e*. There may be one or more other predetermined positions where the boom can be moved under control of the control unit.

Figure 6:
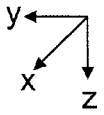
FIG. 6 illustrates a control block diagram of an apparatus for controlling the boom.
Figure 6:
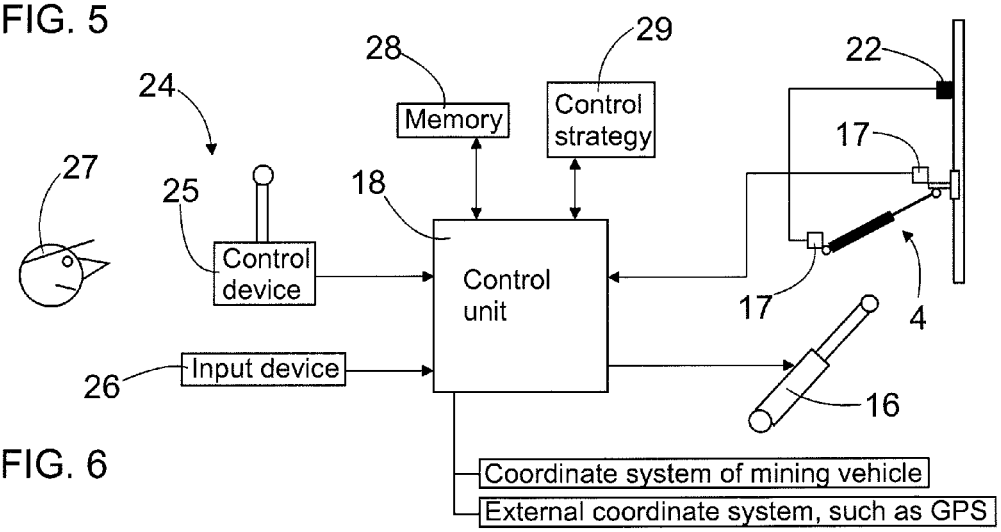

FIG. 6 shows a boom control system 23 including one or more control units 18 and input means 24 for feeding control data and commands to the control unit 18. The input means may include a control device 25, such as a joy-stick, and an input device 26, such as a keypad, by means of which the operator 27 may communicate with the control unit 18. Further, the control unit 18 may read data from one or more memory units 28 and also store data therein. The control unit 18 may be provided with one or more control strategies 29 including operating principles and guidelines for the boom control. The control strategy 29 may include an algorithm for automatically controlling the boom to one or more predetermined positions.

Data concerning the predetermined positions may be stored in the memory unit or media 28. Measuring data is transmitted from different sensors 17, such as boom angle sensors and linear sensors to the control unit 18. Measuring data of an inclinometer 22 is also transmitted to the control unit 18. The control unit 18 may be a computer equipped with an appropriate processor capable of running a software program including a control algorithm and also processing measuring data for producing control information. On the basis of measuring data, manual control commands and the control strategy, the control unit 18 produces control commands for boom actuators 16 allowing automated boom control.

Figure 7:
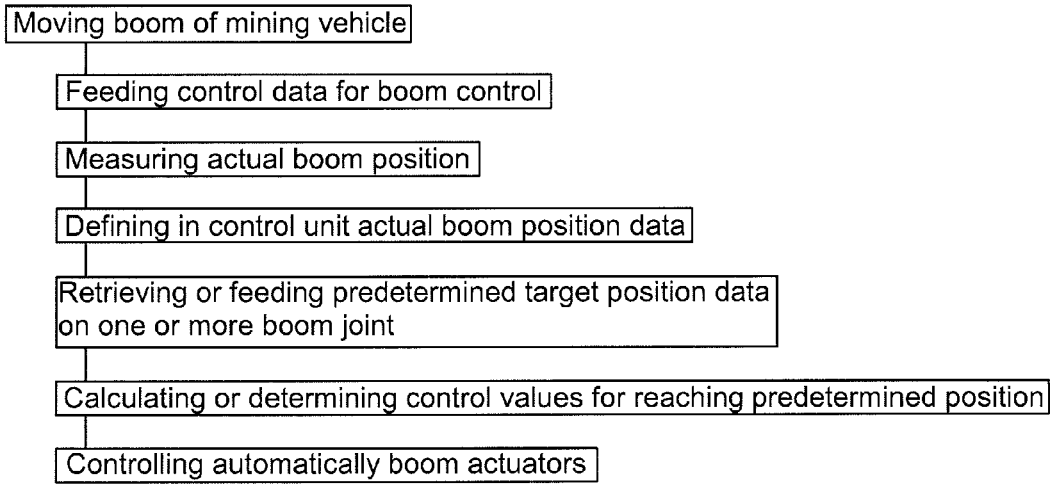
FIG. 7 is a simplified chart showing a boom control procedure in a general concept.

FIG. 7 is a simplified chart showing issues relating to the disclosed boom control. The steps and features presented in this figure are discussed above and especially in section Brief description of the invention.

Figure 8:
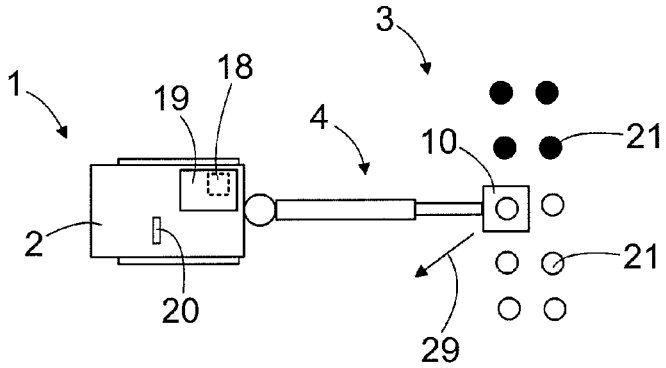
FIG. 8 is a schematic top view illustrating a rock drilling rig and an arrangement for recognizing a desire to start transport movement of the boom.

In FIG. 8 there is illustrated a system for monitoring movements of a boom 4 under manual control and recognizing movements 29 that diverge from the normal operation on a work site 3. When a drilling boom 4 is moved under manual control clearly away from drill holes 21 to be drilled next, the control unit 18 recognizes this and interprets the diverging movement 29 as a desire to move the boom 4 to a transport position. After this the control unit 18 may move the boom 4 to a predetermined position for the transport movement or it may execute a moving sequence and move the boom automatically against a transport support 20. Alternatively, the control unit may monitor movements of a manual control device and recognize situations where the control device is moved to an extreme position or to a predefined position, and on the basis thereof the control unit interprets the control action of the operator as a desire to move the boom to the transport position.

Figure 9:
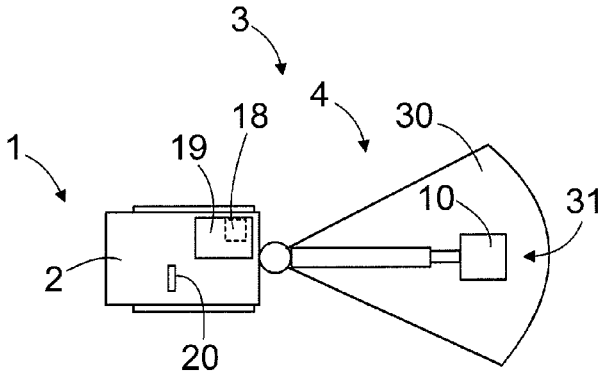
FIG. 9 is a schematic top view illustrating a rock drilling rig and an arrangement for moving a boom to a central position in a boom range.

FIG. 9 is a schematic top view illustrating a rock drilling rig 1 and a boom range 30. The control unit 18 may be arranged to automatically move the boom 4 to a central position 31 in a boom range 30. When in the central position 31, the boom 4 reach is good and operation is fast. The boom can be driven to the central position 31 when the mining vehicle 1 is positioned to a work site 3, for example.

The drawings and the related description are only intended to illustrate the idea of the invention. The details of the invention may vary within the scope of the claims.

The invention claimed is:

1. A mining vehicle comprising:

a movable carrier;

at least one boom having a plurality of boom joints;

at least one sensor arranged to measure at least one boom joint for measuring orientation with respect to gravity;

a plurality of boom actuators for moving the at least one boom in different positions including an operating position;

at least one mining work device arranged at a distal portion of the boom;

measuring means for determining an actual position of the boom; and at least one control unit for controlling the position of the boom according to measurement data received from the measuring means and input control data, wherein at least one position of the boom is predetermined, and at least one intermediate position is determined for the boom between the operating position and the predetermined position, the at least one control unit being configured to utilize measured data received from the at least one sensor when moving the boom to the predetermined position wherein at least lateral swing and forward-backward tilt of the mining work device are determined, to retrieve stored data on the predetermined position of the boom, to move the at least one boom from the operating position to the predetermined position via the at least one intermediate position in response to a received control command, and to move at least one boom joint affecting the lateral swing to a predetermined position and to keep the boom joint unchanged when moving the boom to the predetermined position by moving other boom joints, and wherein a transport position relative to the mining vehicle is pre-defined for the boom, the control unit being arranged to employ stored data on the transport position of the boom and automatically move the boom from any current position to the defined transport position.

2. A mining vehicle as claimed in claim 1, wherein at least one position of at least one boom joint is taught for the at least one control unit by moving the boom in a desired position and the taught position is stored in a memory medium.

3. A mining vehicle as claimed in claim 1, wherein at least one position of the mining work device is predetermined and positions of boom joints realizing the position are stored in a memory medium, the at least one control unit being configured to retrieve the stored data on the boom joints and to automatically move the mining work device to the predetermined position.

4. A mining vehicle as claimed in claim 1, wherein the mining vehicle is a rock drilling rig including at least one drilling boom and a drilling unit at the distal end of the drilling boom, the drilling unit having an elongated feed beam and a drilling machine supported movably on the feed beam, wherein at least one position of the drilling boom is predetermined and positions of the boom joints realizing the predetermined position of the drilling boom are stored in a memory medium, the control unit being configured to retrieve the stored data on the boom joints and to automatically move the drilling boom to the at least one predetermined position.

5. A mining vehicle as claimed in claim 1, wherein several positions of the boom in relation to the carrier are predetermined and positions of boom joints realizing the predetermined boom positions are stored in a memory medium, the control unit being configured to retrieve the stored data on the boom joints and generate a moving sequence for positioning the boom at successive predetermined positions, wherein executing the moving sequence in the control unit is configured to move the boom to the desired boom positions.

6. A mining vehicle as claimed in claim 1, wherein the carrier is provided with at least one transport support for the boom, wherein in the transport position the boom is supported against the at least one transport support.

7. A mining vehicle as claimed in claim 1, wherein the at least one position of the boom is predetermined as a measuring value of the boom joint or as coordinates of boom parts of the boom.

8. A mining vehicle as claimed in claim 1, wherein the boom has a boom range and a predetermined neutral position therein, wherein data on the neutral position is stored in a memory medium, and the control unit being configured to retrieve the stored data and to automatically move the boom to the neutral position.

9. A mining vehicle as claimed in claim 1, the at least one sensor being an inclinometer.

10. A mining vehicle as claimed in claim 1, wherein the mining vehicle is provided with at least one control device, whereby the boom is moved under manual control of an operator during the operation, the control unit being configured to monitor movements of the control device and to detect when the control device is moved to a predetermined extreme position, and to interpret the recognized extreme position of the control device as a request for starting to move the boom from the operational position to a predetermined position, or vice versa.

11. A mining vehicle as claimed in claim 1, further comprising a collision avoidance system for ensuring that the boom or the mining work device on the boom does not hit the ground or a physical obstacle belonging to the mining vehicle, wherein the control unit determines the position of the boom and the mining work device and compare the positions to the obstacle data, and the control unit is arranged to control the movements of the boom joints by taking into account the comparison.

12. A method for moving a boom of a mining vehicle, the method comprising the steps of:

controlling movement of the boom with at least one control unit, the control unit having a processor;

measuring an actual position of the boom by a measuring means;

determining actual position data of the boom in the processor of the control unit on the basis of measuring data;

controlling, by the control unit, boom actuators of the boom for moving joints of the boom to new positions according to the actual position data and the input control data;

moving the boom to a predetermined position under automatic control of the control unit, wherein a transport position relative to the mining vehicle is predefined for the boom, and stored data on the transport position of the boom is employed and the boom is automatically moved from any current position to the defined transport position; and measuring at least one boom joint with at least one sensor having limited operating range;

controlling the boom via at least one intermediate position to a target position;

adjusting in the intermediate position at least one boom joint to a predetermined position required in the target position;

keeping the adjusted boom joint unchanged when moving the boom from the intermediate position towards the target position.

13. A method as claimed in claim 12, further comprising the step of moving the boom between the actual position and the target position according to a predetermined boom sequence, which defines moving order of boom joints.

14. A computer program, the computer program comprising:

program code means configured to cause a mining vehicle to execute the method steps of:

controlling movement of the boom by at least one control unit, the control unit having a processor;

measuring an actual position of the boom by a measuring means;

determining actual position data of the boom in the processor of the control unit on the basis of measuring data;

controlling, by the control unit, boom actuators of the boom for moving joints of the boom to new positions according to the actual position data and the input control data; and moving the boom to a predetermined position under automatic control of the control unit, wherein a transport position relative to the mining vehicle is predefined for the boom, and stored data on the transport position of the boom is employed and the boom is automatically moved from any current position to the defined transport position, when run on a computer;

measuring at least one boom joint with at least one sensor having limited operating range;

controlling the boom via at least one intermediate position to a target position;

adjusting in the intermediate position at least one boom joint to a predetermined position required in the target position; and keeping the adjusted boom joint unchanged when moving the boom from the intermediate position towards the target position, when run on the computer.

15. The computer program of claim 14, wherein the program code means is further configured to cause a mining vehicle to execute the method step of moving the boom between the actual position and a target position according to a predetermined boom sequence, which defines moving order of boom joints, whereby the boom is moved to the target position via at least one intermediate boom position, when run on the computer.

* * * * *